US011072353B2

(12) United States Patent
Liu et al.

(10) Patent No.: US 11,072,353 B2
(45) Date of Patent: Jul. 27, 2021

(54) AUTOMATIC UNCOUPLING MECHANISM FOR COUPLERS

(71) Applicant: CRRC QINGDAO SIFANG ROLLING STOCK RESEARCH INSTITUTE CO., LTD., Qingdao (CN)

(72) Inventors: Quan Liu, Qingdao (CN); Jintao Du, Qingdao (CN); Minggang Li, Qingdao (CN); Jibo Liu, Qingdao (CN)

(73) Assignee: CRRC QINGDAO SIFANG ROLLING STOCK RESEARCH INSTITUTE CO., LTD. X, Qingdao (CN)

( * ) Notice: Subject to any disclaimer, the term of this patent is extended or adjusted under 35 U.S.C. 154(b) by 304 days.

(21) Appl. No.: 16/244,089

(22) Filed: Jan. 9, 2019

(65) Prior Publication Data

US 2019/0144013 A1 May 16, 2019

Related U.S. Application Data

(63) Continuation of application No. PCT/CN2017/097009, filed on Aug. 11, 2017.

(30) Foreign Application Priority Data

Aug. 31, 2016 (CN) ..... 201610778788.8

(51) Int. Cl.
*B61G 7/00* (2006.01)
*B61G 3/20* (2006.01)
*B61G 7/02* (2006.01)

(52) U.S. Cl.
CPC ..... *B61G 7/00* (2013.01); *B61G 3/20* (2013.01); *B61G 7/02* (2013.01)

(58) Field of Classification Search
CPC ... B61G 3/00; B61G 3/10; B61G 3/14; B61G 3/20; B61G 3/26; B61G 7/00; B61G 7/02; B61G 7/04
See application file for complete search history.

(56) References Cited

U.S. PATENT DOCUMENTS 4,073,385 A 2/1978 Reed ..... 213/100 R
4,391,380 A * 7/1983 Hoose ..... B61G 3/06 213/109
5,503,280 A 4/1996 Hanano

FOREIGN PATENT DOCUMENTS

CN 201136515 Y 10/2008
CN 202439714 U 9/2012
(Continued)

OTHER PUBLICATIONS

The International Search Report of corresponding International PCT Application No. PCT/CN2017/097009, dated Oct. 27, 2017.
(Continued)

*Primary Examiner* — Robert J McCarry, Jr.
(74) *Attorney, Agent, or Firm* — J.C. Patents

(57) ABSTRACT

An automatic uncoupling mechanism for couplers comprises a coupler knuckle spindle and a driving unit comprising a cylinder body hinged to a coupler body and a telescopic member; and further comprises a first rotating member, a boss and a boss stopper, wherein the first rotating member comprises a crank hinged to the telescopic member and a rotating part being sheathed on the coupler knuckle spindle. The driving unit unidirectionally drives the telescopic member so that the rotating part drives the coupler knuckle spindle to unidirectionally rotate by the contact of the boss with the boss stopper, realizing coupler uncoupling; and, after the driving unit drives the telescopic member to return to its position, the rotation of the coupler knuckle spindle for achieving coupler coupling is not limited by the
(Continued)

rotating part. The present application may reduce the lateral force of the coupler knuckle to the driving unit during the uncoupling process of the coupler, and may cause the spring to drive the coupler knuckle to rotate rapidly and lock the coupler during the coupler coupling process.

20 Claims, 13 Drawing Sheets

(56) References Cited

FOREIGN PATENT DOCUMENTS

| | | | |
|---|---|---|---|
| CN | 106274958 | A | 1/2017 |
| CN | 200981560 | Y | 11/2017 |
| DE | 20 2007 001 773 | U1 | 4/2007 |
| GB | 448876 | | 6/1936 |
| GB | 1314438 | A | 6/1973 |
| GB | 1 328 253 | | 8/1973 |
| JP | Y 1971-034175 | | 6/1967 |

OTHER PUBLICATIONS

The Chinese Search Report of corresponding China patent application No. 201610778788.8.
Search Report for EP17836441.
The first Office Action of the parallel JP application.

* cited by examiner

A-A

B–B

AUTOMATIC UNCOUPLING MECHANISM FOR COUPLERS

CROSS-REFERENCE TO RELATED APPLICATION

This application is a continuation of International Application No. PCT/CN2017/097009 filed on Aug. 11, 2017, which in turn claims the priority benefits of Chinese application No. 201610778788.8 filed on Aug. 31, 2016. The contents of these prior applications are hereby incorporated by reference in its entirety.

TECHNICAL FIELD

The present application belongs to the technical field of coupling devices for train couplers and particularly relates to an automatic uncoupling mechanism for couplers.

BACKGROUND OF THE PRESENT INVENTION

As the basic composition of a coupling device for couplers, an uncoupling device functions to push a coupler knuckle mechanism to rotate so as to uncouple couplers. Prior uncoupling methods include manual uncoupling and automatic uncoupling, wherein the prior automatic uncoupling method for railway vehicles in China is pneumatic uncoupling. A conventional uncoupling device is shown in FIG. 1. Two uncoupling mechanisms are shown in FIG. 1. Since the two uncoupling mechanisms are the same in structure, only one of them will be described. The conventional uncoupling device includes a coupler body 1' in which a coupler knuckle spindle 2' is provided. The coupler knuckle spindle 2' passes through a coupler knuckle 3' and is able to push the coupler knuckle 3' to rotate. The coupler knuckle 3' is connected to a coupling rod 4'. For example, the connection between the coupler knuckle 3' and the coupling rod 4' may be realized by a pin 5'. The uncoupling device further includes a tension spring 6'. One end of the tension spring 6' is connected to the coupling rod 4', while the other end thereof is connected to the coupler body 1'. A cylinder piston rod 7' is further provided on the coupler body 1' to provide power for pushing the coupler knuckle 3' to move. During uncoupling by a pneumatic uncoupling approach, the cylinder piston rod 7' is stretched out to directly push the coupler knuckle 3' to rotate. However, since the surface of the coupler knuckle 3' coming into contact with the uncoupling piston rod 7' is relatively short, it is very difficult to ensure that the stress direction of the coupler knuckle 3' is always along the direction of the piston rod 7'. As a result, there will be some problems, such as the coupler knuckle 3' applying a large lateral force to the cylinder piston rod 7' and the cylinder piston rod 7' causing damage to the paint on the coupler knuckle.

In order to solve the above technical problems, the Chinese Utility Model CN200981560Y discloses a compact tight-lock coupler, wherein an uncoupling cylinder is disposed in an inner cavity of a coupler body, and one end of the uncoupling cylinder is hinged to an uncoupling crank while the other end thereof is mounted on an inner wall of the coupler body. During uncoupling, uncoupling cylinders of two couplers are inflated, and piston push rods drive uncoupling cranks to push two coupler knuckles to rotate until the two couplers may be uncoupled from each other. After the two couplers are uncoupled from each other, the coupler knuckles return to the to-be-coupled positions due to the tension of tension springs. The uncoupling device provides a technical means for hinging a cylinder piston rod to a coupler knuckle mechanism, so that the technical problems of the large lateral force applied to the cylinder piston and the damage to the paint on the coupler knuckle caused by the cylinder piston rod are solved during uncoupling. However, this uncoupling device still has the following technical problems.

During the coupler coupling process, coupler knuckles of two couplers are pushed to rotate by thrust forces from two trains. After the couplers are rotated to a maximum angle, due to the resistance from the cylinder rod, the coupler knuckles are difficult to quickly rotate and lock the two couplers under the tension of the tension springs.

In order to solve the above technical problems, the Chinese Utility Model CN201136515Y discloses a link-type automatic uncoupling device for tight-lock couplers, wherein a central shaft is disposed in an inner cavity of a coupler knuckle, a spindle is fixedly mounted on the central shaft, an uncoupling crank is hinged to the spindle by a connecting rod, and a cylinder piston of an uncoupling cylinder is positioned at the tail of the spindle. In addition, the uncoupling device further provides a spring sheathed on the cylinder piston. With the uncoupling device, during the coupler coupling process, the load experienced by the tension spring when pulling the coupler knuckle to return to its position is relieved. However, in this uncoupling device, the resistance generated when the tension spring pulls the coupler knuckle to return to its position is not completely eliminated, so during the coupler coupling process, the coupler knuckle is still very difficult to quickly rotate and lock two couplers under the tension of the tension spring.

SUMMARY OF THE PRESENT INVENTION

In view of the problems in the prior automatic uncoupling devices for couplers, the present application provides a novel automatic uncoupling mechanism for couplers.

The present application employs the following technical solutions.

An automatic uncoupling mechanism for couplers comprises a coupler knuckle spindle and a driving unit. The driving unit comprises a cylinder body hinged to a coupler body and a telescopic member axially movable along the cylinder body. The automatic uncoupling mechanism for couplers further comprises a first rotating member, a boss and a boss stopper, wherein the first rotating member comprises a crank hinged to the telescopic member and a rotating part fixedly connected to the crank, with the rotating part being sheathed on the coupler knuckle spindle. The driving unit unidirectionally drives the telescopic member so that the rotating part drives the coupler knuckle spindle to unidirectionally rotate by the contact of the boss with the boss stopper, so as to realize coupler uncoupling; and, after the driving unit drives the telescopic member to return to its position, the rotation of the coupler knuckle spindle for achieving coupler coupling is not limited by the rotating part.

As a preferred embodiment, the automatic uncoupling mechanism for coupler further comprises a second rotating member for limiting the movement of the rotating part in an axis direction of the coupler knuckle spindle, and the second rotating member is fixedly connected to the coupler knuckle spindle.

As a preferred embodiment, the boss is fixedly mounted on the rotating part.

As a preferred embodiment, a groove is formed on a side face of the coupler knuckle spindle, the boss stopper is a radial sidewall of the groove, and the dimension of the groove in a circumferential direction of the coupler knuckle spindle is greater than or equal to the maximum movement distance of the boss.

As a preferred embodiment, the boss stopper is of a block structure fixed on the coupler knuckle spindle.

As a preferred embodiment, a groove is formed on the second rotating member, the boss stopper is a radial sidewall of the groove, and the dimension of the groove in a circumferential direction of the coupler knuckle spindle is greater than or equal to the maximum movement distance of the boss.

As a preferred embodiment, the boss stopper is of a block structure fixed on the second rotating member.

The above implementations may be summarized as below.

(1) A groove is formed on a side wall of the coupler knuckle spindle or on the second rotating member, the boss stopper is a radial sidewall of the groove, and the dimension of the groove in a circumferential direction of the coupler knuckle spindle or the second rotating member is greater than or equal to the maximum movement distance of the boss. During movement, the boss is driven by the rotating part to push a side of the groove, so as to eventually rotate the coupler knuckle spindle.

(2) The boss stopper is of a block structure fixed on the coupler knuckle spindle or on the second rotating member. During movement, the boss is driven by the rotating part to push the boss stopper to move, so as to eventually rotate the coupler knuckle spindle.

As an alternative embodiment, the arrangement positions between the boss and the groove/block structure may be changed with each other, i.e., the boss is disposed on the coupler knuckle spindle or on the second rotating member, while the groove or the block structure is formed on the rotating part. The boss and the groove/block structure are matched with each other, and the boss is driven to move by the groove or the block structure. During movement, the block structure or a side of the groove is driven by the rotating part to push the boss, so as to rotate the coupler knuckle spindle.

As a preferred embodiment, the driving unit is an electric cylinder.

As a preferred embodiment, a sleeve is provided between an inner wall of the first rotating member and a side face of the coupler knuckle spindle.

As a preferred embodiment, the second rotating member is fixed on the coupler knuckle spindle by two or more screws.

As a preferred embodiment, the mechanism further comprises a manual uncoupling device, comprising a handle; one end of the handle is a rotating head, and a clamping member is provided on a face of the rotating head.

As a preferred embodiment, in accordance with the actual mounting approach of the second rotating member, the clamping member is of a raised structure or a hole structure.

Compared with the prior art, the advantages and positive effects of the present application are as follows:

1. The present application improves the uncoupling mechanism of the existing automatic coupling device for couplers, that is, by providing the first rotating member, the boss and the boss stopper and configuring the split-type connection relationship between the first rotating member and the coupler knuckle spindle, the coupler knuckle spindle may be rotated simultaneously with the first rotating member during the uncoupling process, and independently operated during the coupling process, so as to ensure that the tension spring drives the coupler knuckle to rotate rapidly and lock the coupler, thereby it is beneficial to implement the coupler coupling under the promise of ensuring automatic uncoupling approach of high efficiency.

2. The automatic uncoupling mechanism provided by the present application may reduce the lateral force of the coupler knuckle to the driving unit during the uncoupling process of the coupler, and may cause the spring to drive the coupler knuckle to rotate rapidly and lock the coupler during the coupler coupling process.

3. The automatic uncoupling approach of the existing railway vehicles in China are all pneumatic uncoupling. However, the pneumatic uncoupling approach has low response speed, difficult maintenance and poor stability, and the pneumatic uncoupling requires an air source, generally an air compressor, with the disadvantages of occupying a large volume and having a large noise, etc. Therefore, by using the electric cylinder, the existing pneumatic uncoupling approach is improved into an electric uncoupling approach, thereby improving the response speed and stability of the automatic uncoupling device for couplers, reducing the maintenance cost of the automatic uncoupling device for couplers, saving space and improving comfort.

4. Although the application of the electric uncoupling approach may achieve the technical effect such as the above-mentioned high response speed and high stability, the electric cylinder used in the electric uncoupling approach has a high self-locking force, which has a great hindrance to the couple of the couplers of the automatic uncoupling device for couplers. Therefore, in order to overcome the difficult that the electric uncoupling approach may not be applied to the automatic uncoupling device for couplers, the present application combines the split-type connection approach of the first rotating member with the coupler knuckle spindle and the electric uncoupling approach, thereby improving the stability of the automatic uncoupling device for couplers and the efficiency of uncoupling, and ensuring the smooth implement of the couplers coupling process.

Figure 1:
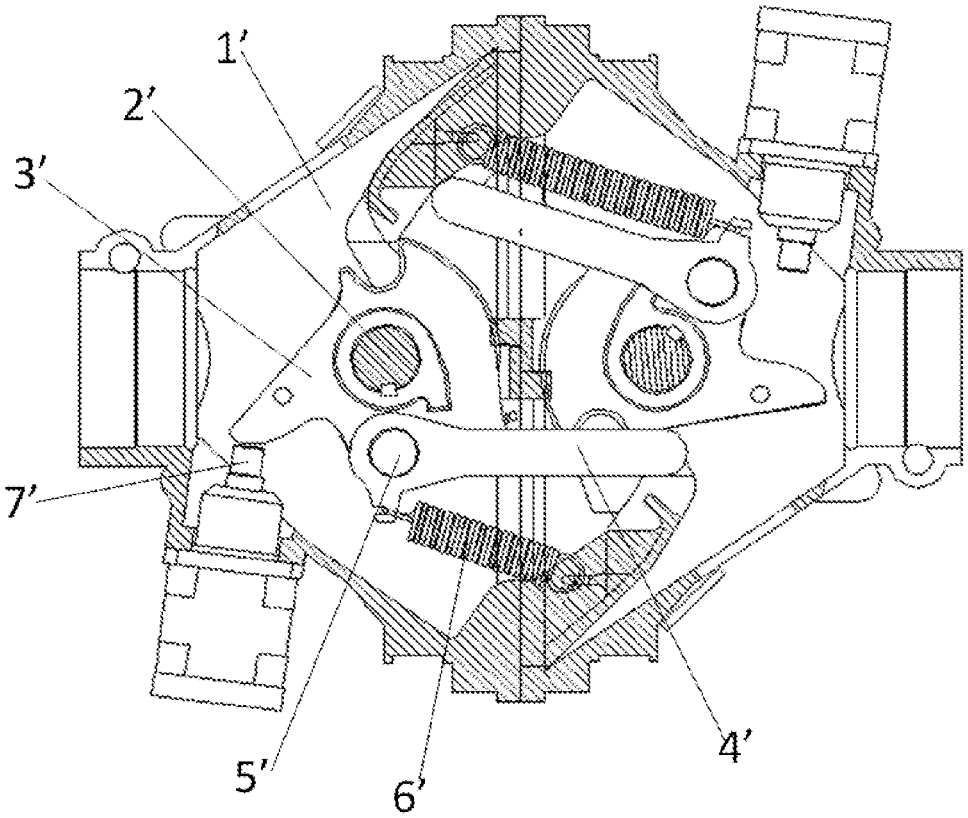
FIG. 1 (PRIOR ART)
FIG. 1 is a schematic structure diagram of a prior uncoupling device for couplers.

in which:

1' coupler body; 2' coupler knuckle spindle; 3' coupler knuckle; 4' coupling rod; 5' pin; 6' tension spring; 7' cylinder piston rod; 1 coupler knuckle spindle; 2 driving unit; 201 cylinder body; 202 telescopic member; 3 coupler body; 4 first rotating member; 401 crank; 402 rotating part; 5 boss; 6 boss stopper; 7 second rotating member; 8 screw; 9 washer; 10 groove; 11 upper sidewall; 12 coupler knuckle; 13 coupling rod; 14 pin; 15 tension spring; 16 key; 17 first shaft sleeve; 18 second shaft sleeve; 19 sleeve; 20 manual uncoupling device; 21 handle; 22 rotating head; 23 clamping member.

DETAILED DESCRIPTION OF THE PRESENT INVENTION

In the following, the present application is specifically described by way of exemplary embodiments. However, it should be understood that elements, structures, and features of an embodiment may be beneficially incorporated into other embodiments without further recitation.

In the description of the present application, it should be noted that the terms "inside", "outside", "up", "down", "front", "back", "left", "right", "clockwise", "anticlockwise" and the like indicate the positional or positional relationship according to the positional relationship shown in the drawings merely for the convenience of describing the present application and the simplified description, but do not indicate or imply a devices or an element referred to must be of a particular orientation, constructed and operated in a particular orientation and therefore should not be construed as limiting the present application. Moreover, the terms "first", "second", "third" and the like are used merely for descriptive purposes and should not be understood as indicating or implying relative importance.

As shown in FIGS. 2-8, an automatic uncoupling mechanism for couplers is provided, including a coupler knuckle spindle 1 and a driving unit 2. The driving unit 2 includes a cylinder body 201 hinged to a coupler body 3 and a telescopic member 202 capable of moving in an axial direction of the cylinder body 201. The automatic uncoupling mechanism for couplers further includes a first rotating member 4, a boss 5 and a boss stopper 6, wherein the first rotating member 4 includes a crank 401 hinged to the telescopic member 202 and a rotating part 402 fixedly connected to the crank 401. The rotating part 402 is sheathed on the coupler knuckle spindle 1. The driving unit 2 unidirectionally drives the telescopic member 202 so that the rotating part 402 drives the coupler knuckle spindle 1 to unidirectionally rotate by a contact between the boss 5 and the boss stopper 6, so as to realize coupler uncoupling. After the driving unit 2 drives the telescopic member 202 to return to its position, the rotation of the coupler knuckle spindle 1 for achieving coupler coupling is not limited by the rotating part 402.

Figure 6:
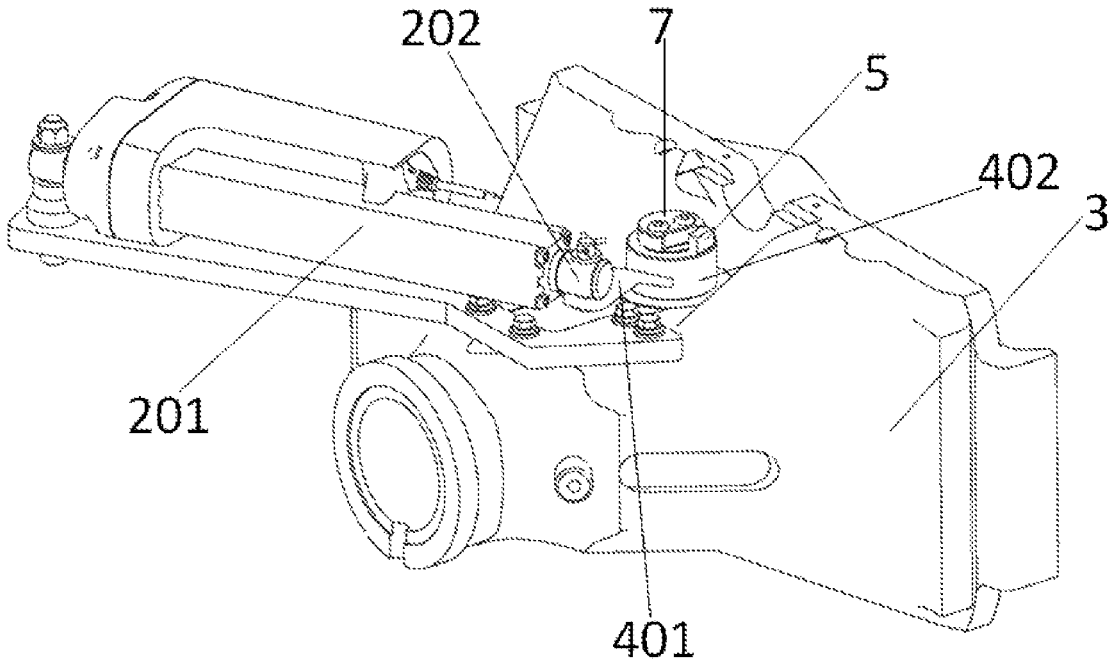
FIG. 6 is a right perspective view of the automatic uncoupling mechanism for couplers.
Figure 7:
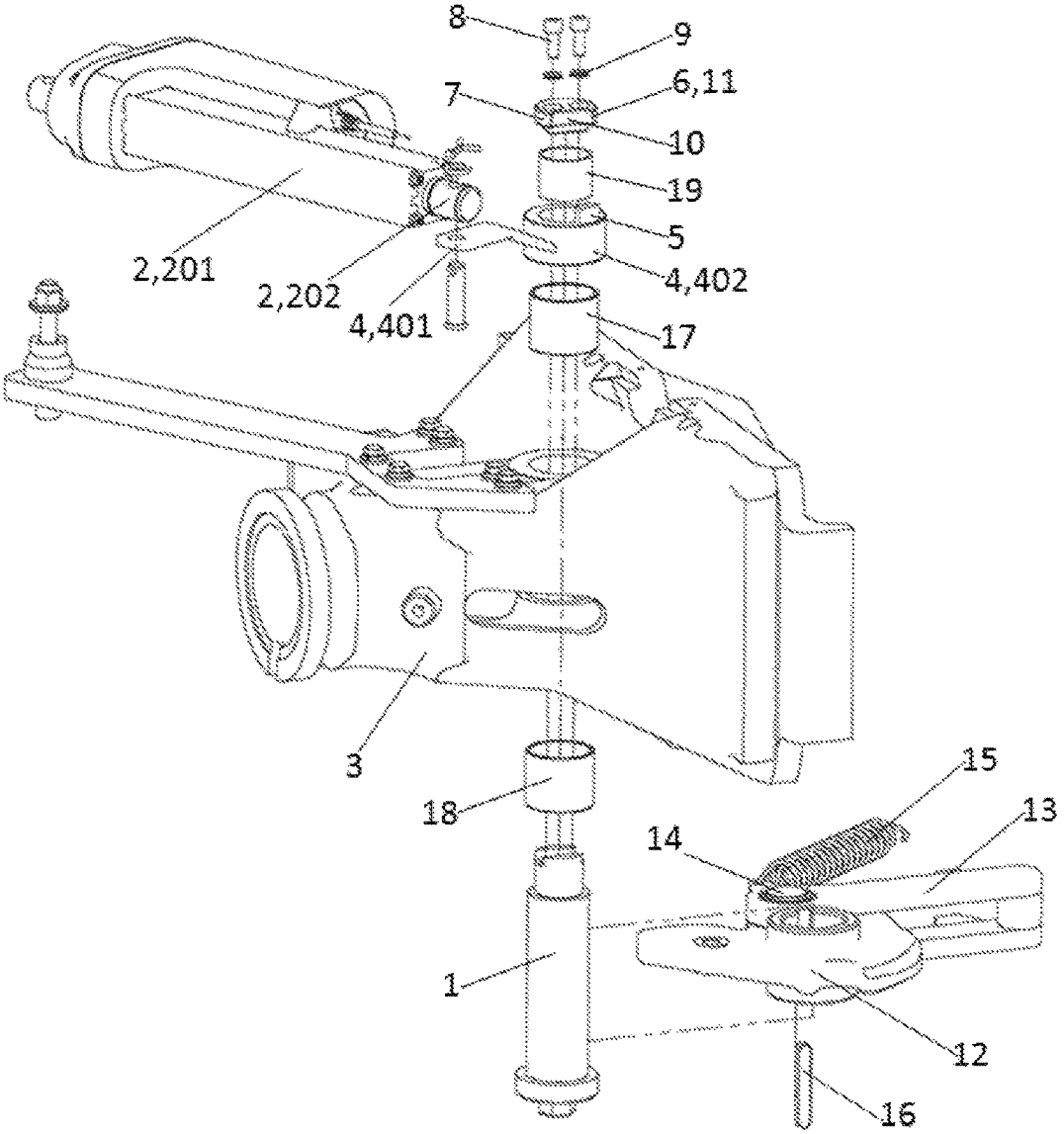
FIG. 7 is an exploded view corresponding to FIG. 6.
Figure 8:
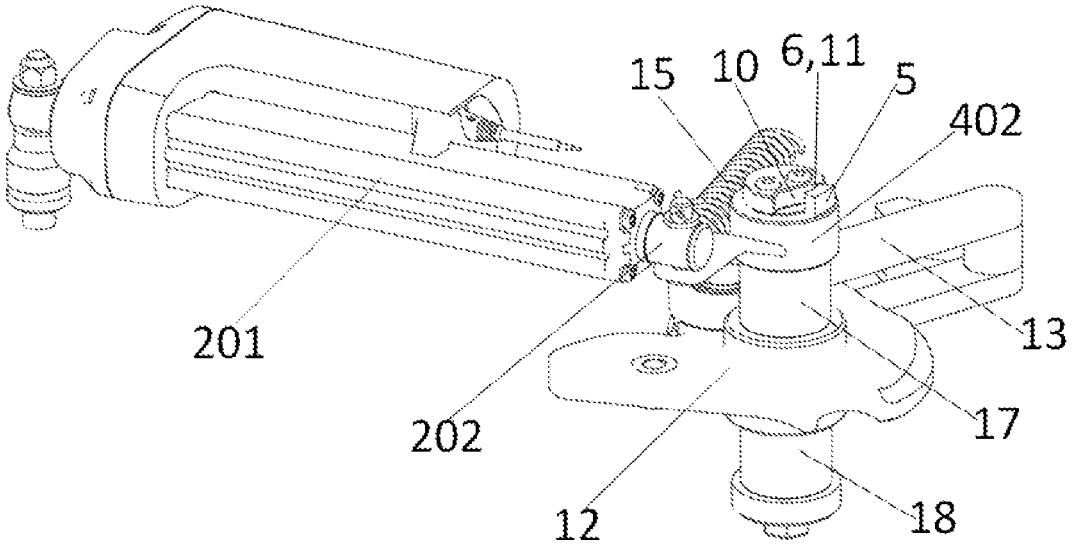
FIG. 8 is a connection diagram of components after a coupler body is omitted.

The hinged connection may be a direct hinged connection between components, or may be an indirect hinged connection. As shown in FIGS. 6 and 7, the hinged connection between the driving unit 2 and the coupler body 3 may be a hinged connection between a support plate located under the driving unit 2 with the coupler body 3, so that the hinged connection between the driving unit 2 and the coupler body 3 is an indirect hinged connection; and the direct hinged connection between the telescopic member 202 and the crank 401 may be realized by a pin, a fixation member or other conventional components.

In order to prevent the movement of the first rotating member 4 in an axis direction of the coupler knuckle spindle 1 from causing the unstable rotation of the first rotating member 4, as a preferred embodiment, the automatic uncoupling mechanism for couplers further includes a second rotating member 7 for limiting the movement of the rotating part 402 in the axis direction of the coupler knuckle spindle 1, and the second rotating member 7 is located above the rotating part 402 and fixedly connected to the coupler knuckle spindle 1.

By providing the first rotating member 4, the boss 5 and the boss stopper 6 and by providing the split-type connection between the first rotating member 4 and the coupler knuckle spindle 1, the coupler knuckle spindle 1 is enabled to simultaneously rotate with the first rotating member 4 during the coupler uncoupling process but independently rotate during the coupler coupling process. Consequently, it is ensured that the tension spring drives the coupler knuckle to quickly rotate and lock the couplers, and it is advantageous for smooth coupler coupling under the premise of ensuring high efficiency of the automatic uncoupling approach.

Figure 2:
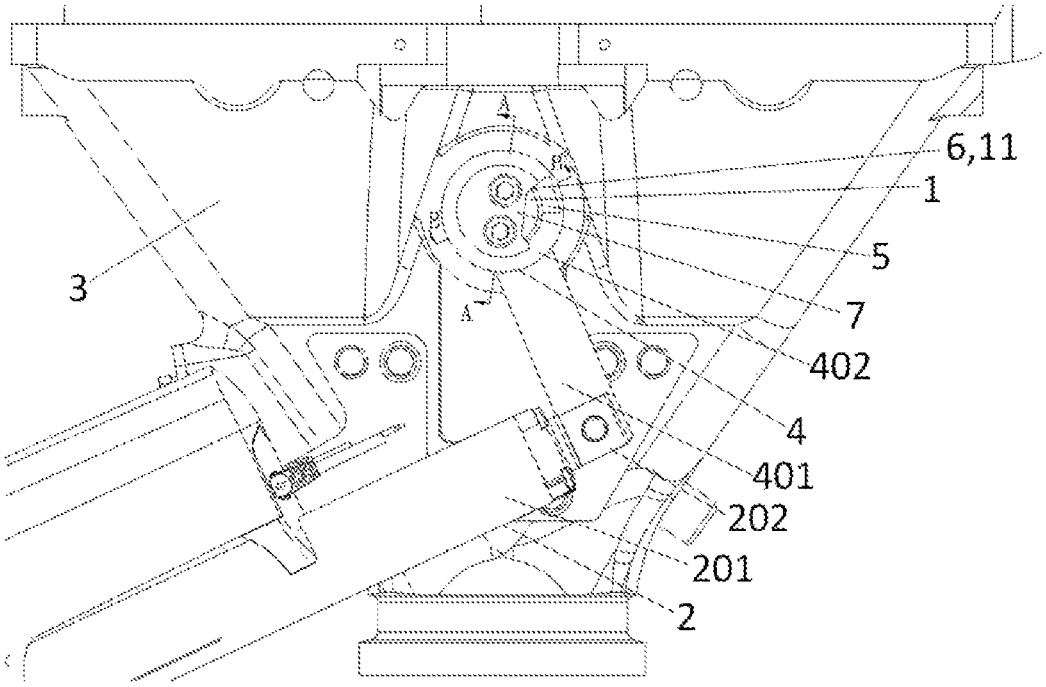
FIG. 2 is a top view of an automatic uncoupling mechanism for couplers according to the present application.
Figure 3:
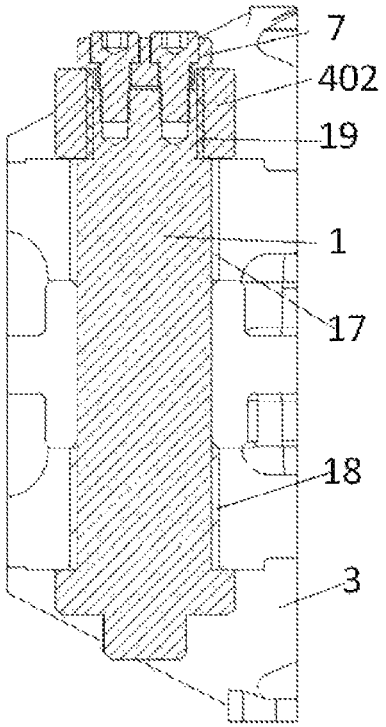
FIG. 3 is a sectional view of FIG. 2 taken along section A-A.
Figure 4:
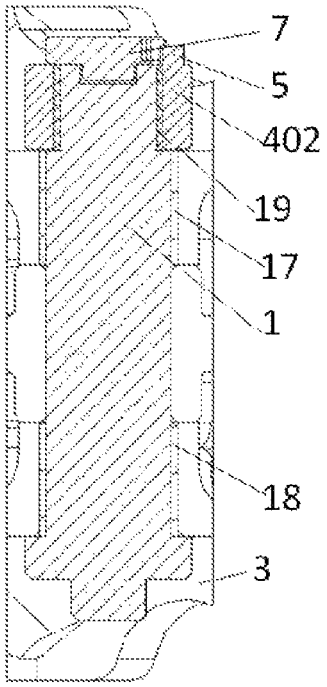
FIG. 4 is a sectional view of FIG. 2 taken along section B-B.
Figure 5:
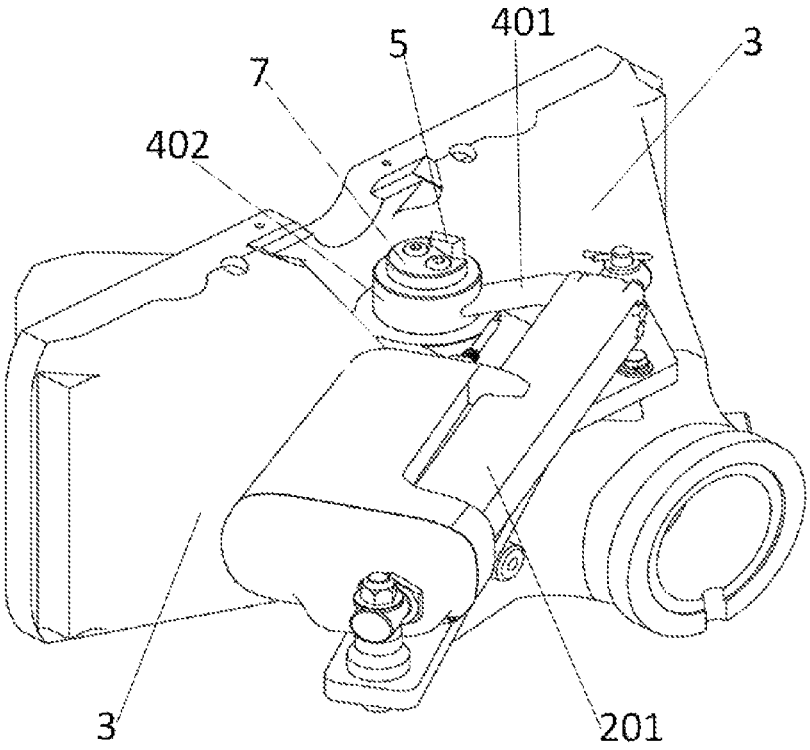
FIG. 5 is a left perspective view of the automatic uncoupling mechanism for couplers.

As a specific embodiment, as shown in FIGS. 2-8, the boss 5 may be fixedly mounted above the rotating part 402. The second rotating member 7 is located above the rotating part 402 and may be a cover plate structure. Left and right portions of the second rotating member 7 come into close contact with the rotating part 402 (as shown in FIGS. 3 and 4), that is, the second rotating member 7 may cover the rotating part 402 to avoid the movement of the rotating part in the axial direction. The position of the boss 5 corresponds to that of the second rotating member 7. As shown in FIGS. 6 and 7, in order to prevent the second rotating member 7 from rotating out from the coupler knuckle spindle 1, the second rotating member 7 may be fixed on the coupler knuckle spindle 1 by two or more screws 8. During the fixation of the screws 8, components such as washer 9 may also be used for purpose of realizing firmer fixation. As shown in FIGS. 2-8, a groove 10 is formed on the second rotating member 7, and the boss stopper 6 is a radial sidewall of the groove 10, i.e., an upper sidewall 11 shown in FIG. 2.

In order to understand the technical solutions of the present application more clearly, the conventional techniques related to the present application will be briefly described herein. As shown in FIGS. 1 and FIGS. 6-8, wherein the reference numerals in the parentheses are reference numerals in FIG. 1, a coupler knuckle spindle 1(2') and a coupler knuckle 12(3') are included in the coupler body 3(1'); the coupler knuckle spindle 1(2') passes through the coupler knuckle 12(3'), and the coupler knuckle spindle 1(2') can push the coupler knuckle 12(3') to rotate; the coupler knuckle 12(3') is connected to a coupling rod 13(4'), both of which may be connected by a pin 14(5'); a tension spring 15(6') is further included in the coupler body 3(1'); and, one end of the tension spring 15(6') is connected to the coupling rod 13(4'), while the other end thereof is connected to the coupler body 3(1'). It should be understood that pushing the coupler knuckle 12(3') by the coupler knuckle spindle 1(2') may be realized by a key 16. A first shaft sleeve 17 and a second shaft sleeve 18 may be further provided on the upper and lower of the coupler knuckle spindle 1(2'), respectively, to ensure the reliable rotation between the coupler knuckle spindle 1(2') and the coupler body 3(1'). These technical solutions may be regarded as prior technical solutions.

In the case of understanding the technical solutions of the present application in combination with the prior art, in order to enable the coupler knuckle 12 to completely return to its position by the tension spring 15 during the coupler coupling process, as a preferred embodiment, the dimension of the groove 10 in a circumferential direction of the coupler knuckle spindle 1 should be greater than or equal to the maximum movement distance of the boss 5.

The maximum movement distance of the boss means that: during uncoupling, it can be ensured that the boss 5 is able to push (directly or indirectly) the coupler knuckle spindle 1 to rotate and thus drive the coupler knuckle 12 and the coupling rod 13 to a completely uncoupling position; while during coupling, it is ensured that the rotation of the boss 5 will not be hindered by the second rotating member 7 or the coupler knuckle spindle 1 (except for friction).

The above specific embodiment has the following advantages. On one hand, by providing the second rotating member 7, the rotation of the rotating part 402 is more stable; on the other hand, by arranging the boss stopper 6 on the second rotating member 7 and fixing the second rotating member 7 by two or more screws 8, the relative rotation between the second rotating member 7 and the coupler knuckle spindle 1 is further limited, so that the damage to the coupler knuckle spindle 1 caused by a direct contact of the boss 5 with the coupler knuckle spindle 1 is avoided and it is advantageous for ensuring longer service life of the coupler knuckle spindle 1.

Figure 9:
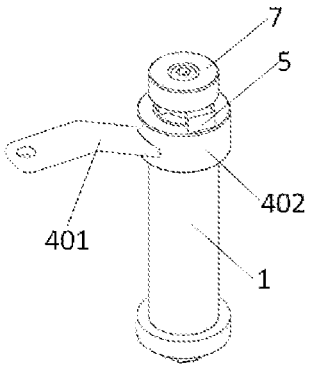
FIG. 9 is a matching view of a boss and a groove in another implementation.
Figure 10:
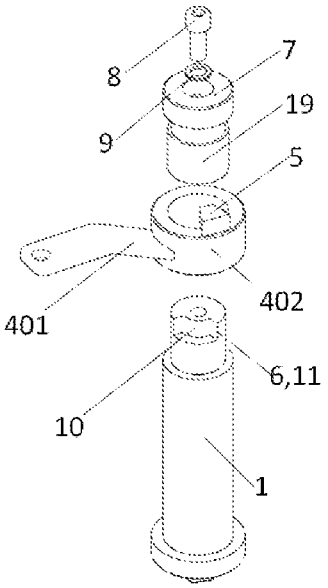
FIG. 10 is an exploded view of FIG. 9.

As another variant of the above specific embodiment, as shown in FIGS. 9 and 10 and for ease understanding of the technical solutions, some components are omitted, wherein a groove 10 is formed on a side face of the coupler knuckle spindle 1 and the boss stopper 6 is a radial sidewall 11 of the groove 10. During assembly, the boss 5 may be extended into the groove 10, and by pushing the radial sidewall 11 of the groove 10, the coupler knuckle spindle 1 is pushed to rotate. During this process, if a second rotating member 7 is further provided, the second rotating member 7 merely functions to limit the axial movement of the rotating part 402 without transferring rotation. Similarly, in order to enable the coupler knuckle 12 to completely return to its position by the tension spring 15 during the coupler coupling process, the dimension of the groove 10 in a circumferential direction of the coupler knuckle spindle 1 is still required to be greater than or equal to the maximum movement distance of the boss 5.

As a variant of the above specific embodiment, the boss stopper 6 may also be of a block structure (not shown). The block structure may be fixedly mounted on the second rotating member 7 and correspond to the boss 5 in terms of position; or the block structure may be fixed on the coupler knuckle spindle 1 and correspond to the boss 5 in terms of position.

The advantageous of designing the boss stopper 6 as a block structure is that, compared with the approach of forming the groove 10, the approach of providing a block structure has no requirement on the dimension limitation and convenient for machining. If the approach of mounting the block structure on the coupler knuckle spindle 1 is employed, the second rotating member 7 merely functions to limit the axial movement of the rotating part 402, and the number of the screws 8 is not limited.

It is to be noted that, for the approach of arranging the boss stopper 6 on the coupler knuckle spindle 1, the second rotating member 7 may be omitted. In this way, it is also possible to achieve the purpose of ensuring a smooth coupler coupling process by the automatic uncoupling mechanism for couplers in the present application.

As a variant of the above specific embodiment, the specific structures of the boss 5 and the boss stopper 6 may be changed with each other. For example, in the above specific embodiment, the boss 5 is arranged on the rotating part 402, the groove 10 is arranged on a side face of the coupler knuckle spindle 1 or on the second rotating member 7, and when the telescopic member 202 is stretched out, a side (as the boss stopper 6) of the groove 10 is pushed by the boss 5 so as to eventually rotate the coupler knuckle spindle 1; and after change, the boss may be arranged on a side face of the coupler knuckle spindle 1 or on the second rotating member 7, the groove is formed on the rotating part 402, and when the telescopic member 202 is stretched out, the boss is pushed by a side of the groove so as to eventually rotate the coupler knuckle spindle 1.

Or, when the originally used boss stopper 6 is of a block structure, after change, the boss may be arranged on a side face of the coupler knuckle spindle 1 or on the second rotating member 7, and the block structure is arranged on the rotating part 402. In this case, when the telescopic member 202 is stretched out, the boss is pushed by the block structure so as to eventually rotate the coupler knuckle spindle 1.

As an improvement of the above specific embodiment, as shown in FIGS. 2 and 7, the driving unit 2 of the automatic uncoupling mechanism for couplers is set as an electric cylinder. By using the electric cylinder, the existing pneumatic uncoupling approach is improved into an electric uncoupling approach, so that the response speed and stability of the automatic uncoupling device for couplers are improved and the maintenance cost thereof is reduced.

It is to be noted that, although the technical effects such as high response speed and high stability can be achieved by replacing the existing pneumatic uncoupling approach with the electric uncoupling approach, the electric cylinder used in the electric uncoupling approach has a very high self-locking force, which will greatly hinder the coupler coupling of the automatic uncoupling device for couplers. Therefore, in order to overcome the difficulty that the electric uncoupling approach cannot be applied to the automatic uncoupling device for couplers, the present application combines the split-type connection approach of the first rotating member 4 and the coupler knuckle spindle 1 with the electrical uncoupling approach, so that the stability and uncoupling efficiency of the automatic uncoupling device for couplers can be improved and the smooth coupler coupling process can also be ensured.

As an improvement of the above specific embodiment, as shown in FIGS. 3 and 4, in order to prevent dry friction from generating between the first rotating member 4 and the coupler knuckle spindle 1 or the second rotating member 7 and thus influencing the realization of the technical effects of the present application, a sleeve 19 is provided between an inner wall of the first rotating member 4 and a side face of the coupler knuckle spindle 1.

Figure 11:
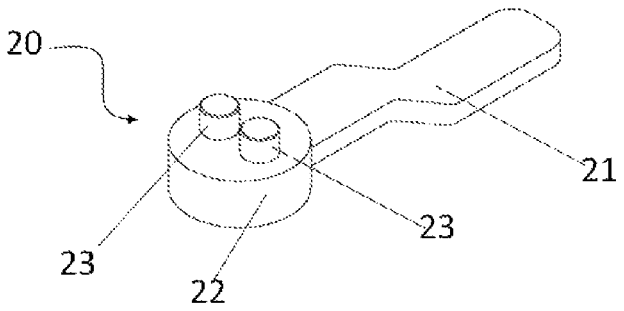
FIG. 11 is a first schematic diagram of a manual uncoupling device.
Figure 12:
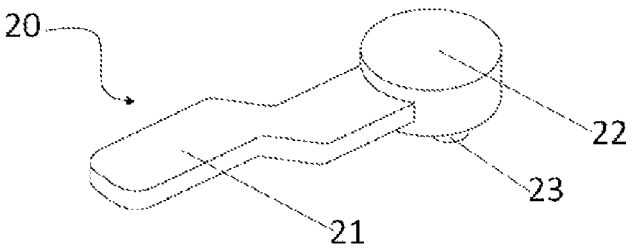
FIG. 12 is a second schematic diagram of the manual uncoupling device.

As a preferred embodiment, the present application further provides a manual uncoupling device 20, which may be used for realizing manual uncoupling for couplers in a case where the crank 401 or the rotating part 402 does not operate properly. As shown in FIGS. 11-12, the manual uncoupling device 20 includes a handle 21. One end of the handle 21 is a rotating head 22 of a flat plate structure. A clamping member 23 is provided on a face of the rotating head 22. There are one or more clamping members 23. Optionally, the number of the clamping members is equal to the number of the screws 8.

When the screws 8 are embedded into the outer surface of the second rotating member 7, the clamping members 23 are of a raised structure matched with the screws. As shown in FIGS. 11-12, the clamping members are two raised structures matched with mounting ports of the screws 8. When the screws 8 are protruded from the outer surface of the second rotating member 7, the clamping member 23 is of a hole structure (not shown) matched with the screws. No matter how the screws and the clamping members are matched, the operation principle is as follows: when the electric rotation or pneumatic rotation works improperly, the clamping members 23 of the manual uncoupling device 20 is matched with the screws 8 or screw holes, and the handle 21 is rotated to drive the coupler knuckle spindle 1 to rotate so as to realize uncoupling.

Now the operation process of the automatic uncoupling mechanism for couplers in the present application will be described by taking the specific structure shown in FIGS. 13-15 as example.

Figure 13:
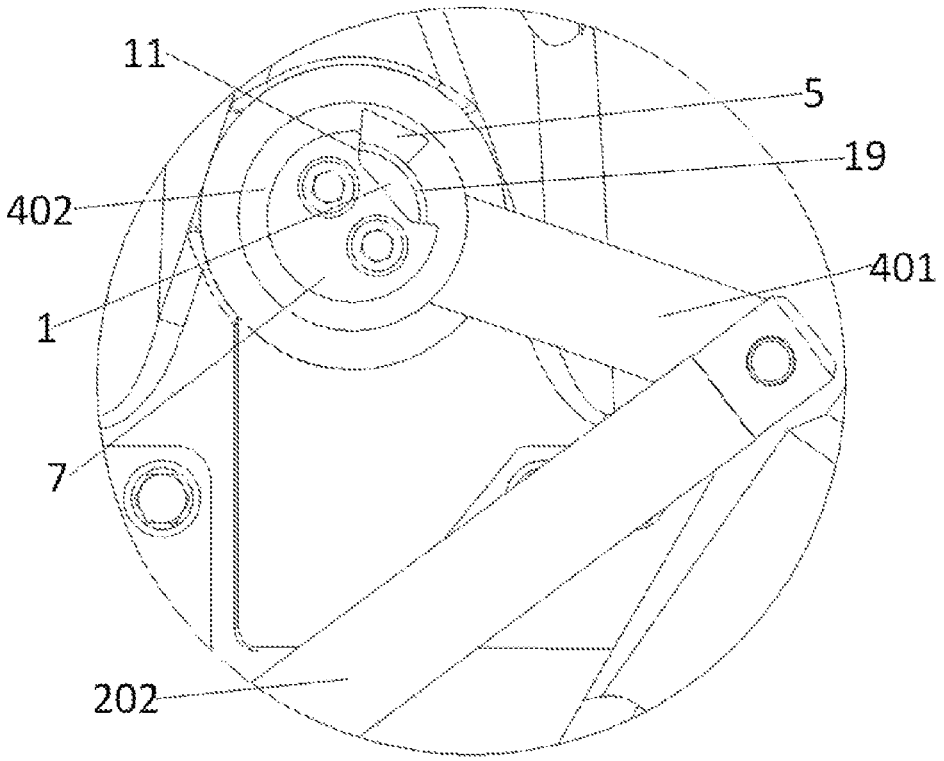
FIG. 13 is a partial view of the automatic uncoupling mechanism for couplers when two couplers may be completely uncoupled from each other during the coupler uncoupling process.

As shown in FIG. 13, during the coupler uncoupling, the telescopic rod 202 is stretched out under the drive of the cylinder body 201 and then drives the crank 401 to rotate counterclockwise, and the crank 401 drives the rotating part 402 to counterclockwise rotate around the axis of the coupler knuckle spindle 1. As shown in FIG. 13, the first rotating member 4 drives the second rotating member 7 to rotate counterclockwise by the work of boss 5 and the side wall 11 of the groove formed on the second rotating member 7. It can be seen from FIGS. 13 and 3 that the rotation of the second rotating member 7 drives the coupler knuckle spindle 1 to rotate counterclockwise, and when two couplers can be completely uncoupled from each other, the coupler knuckle spindle 1 stops rotating.

Figure 14:
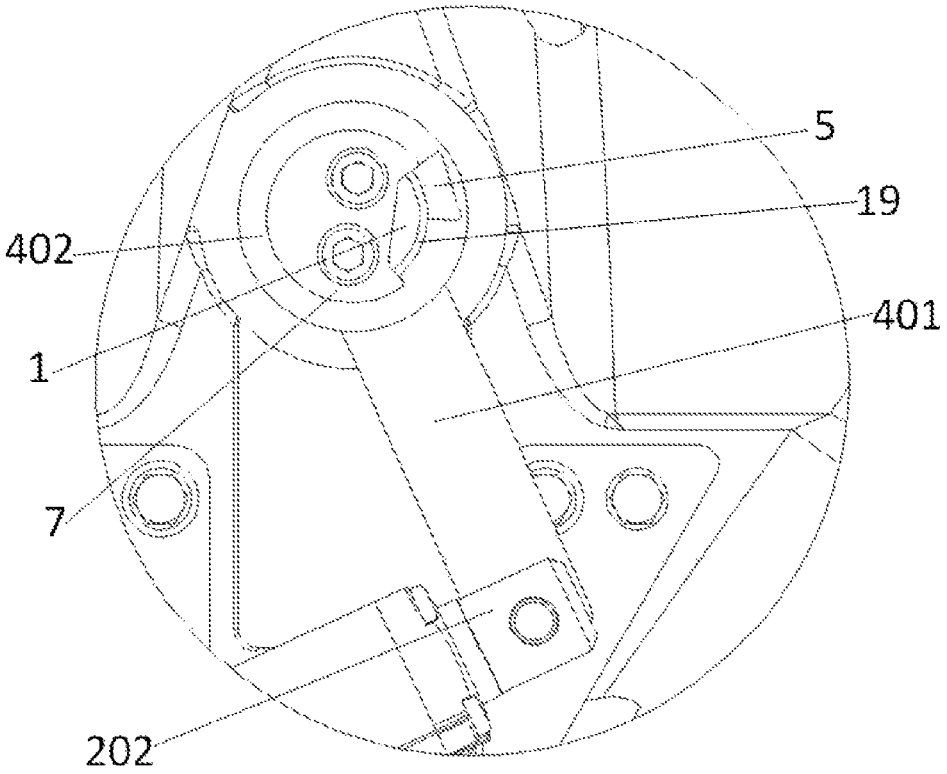
FIG. 14 is a partial view of the automatic uncoupling mechanism for couplers after couplers are uncoupled.

As shown in FIG. 14, after the coupler uncoupling, the telescopic rod 202 is retracted to the initial position shown in FIGS. 2 and 14. Meanwhile, due to the work of the tension spring 15, the second rotating member 7 drives the coupler knuckle spindle 1 to rotate clockwise.

Figure 15:
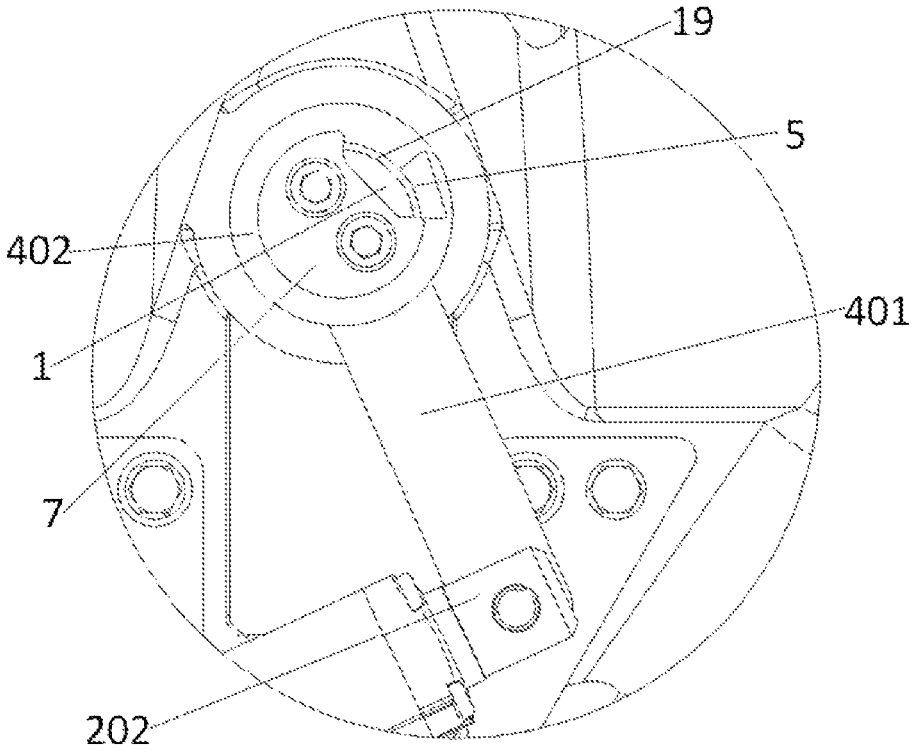
FIG. 15 is a partial view of the automatic uncoupling mechanism for couplers when coupler knuckles of two couplers are rotated to the maximum angle during the coupler coupling.

As shown in FIG. 15, during the coupler coupling, coupler knuckles 12 of two couplers are pushed to rotate counterclockwise by the thrust forces from two trains, and the coupler knuckle spindle 1 is driven to rotate counterclockwise until the two couplers 12 are rotated to the maximum angle and reach the fully opened position (that is, being rotated to the position shown in FIG. 15). In this case, the coupler knuckle spindle 1 is rotated clockwise to the initial position shown in FIG. 2 due to the tension of the tension spring 15. During the whole coupler coupling process, the first rotating member 4 is not rotated.

What is claimed is:

1. An automatic uncoupling mechanism for couplers, comprising a coupler knuckle spindle (1) and a driving unit (2);

the driving unit (2) comprises a cylinder body (201) hinged to a coupler body (3), and a telescopic member (202) axially movable along the cylinder body (201);

wherein, the automatic uncoupling mechanism further comprises a first rotating member (4), a boss (5) and a boss stopper (6);

the first rotating member (4) comprises a crank (401) hinged to the telescopic member (202), and a rotating part (402) fixedly connected to the crank (401), with the rotating part (402) being sheathed on the coupler knuckle spindle (1);

the boss (5) is mounted on the rotating part (402);

the boss stopper (6) is arranged on the coupler knuckle spindle (1);

the driving unit (2) unidirectionally drives the telescopic member (202) so that the rotating part (402) drives the coupler knuckle spindle (1) to unidirectionally rotate by a contact of the boss (5) with the boss stopper (6), so as to realize coupler uncoupling; and, after the driving unit (2) drives the telescopic member (202) to return to its position, the rotation of the coupler knuckle spindle (1) for achieving coupler coupling is not limited by the rotating part (402).

2. The automatic uncoupling mechanism for coupler according to claim 1, wherein, the boss (5) is fixedly mounted on the rotating part (402).

3. The automatic uncoupling mechanism for coupler according to claim 2, wherein, a groove (10) is formed on a side wall of the coupler knuckle spindle (1); the boss stopper (6) is a radial sidewall (11) of the groove; and a dimension of the groove (10) in a circumferential direction of the coupler knuckle spindle (1) is greater than or equal to the maximum movement distance of the boss (5).

4. The automatic uncoupling mechanism for coupler according to claim 3, wherein, arrangement positions between the boss (5) and the groove (10) are changed with each other; the boss and the groove are matched with each other; and the boss is driven to move by the groove.

5. The automatic uncoupling mechanism for coupler according to claim 4, wherein, the driving unit (2) is an electric cylinder.

6. The automatic uncoupling mechanism for coupler according to claim 4, wherein, a sleeve (19) is provided between an inner wall of the first rotating member (4) and a side face of the coupler knuckle spindle (1).

7. The automatic uncoupling mechanism for coupler according to claim 4, wherein, further comprises a manual uncoupling device (20), comprising a handle (21); one end of the handle (21) is a rotating head (22), and a clamping member (23) is provided on a face of the rotating head (22); the clamping member (23) is of a raised structure or a hole structure.

8. The automatic uncoupling mechanism for coupler according to claim 1, wherein, further comprises a second rotating member (7) for limiting the movement of the rotating part (402) in an axis direction of the coupler knuckle spindle (1); and the second rotating member (7) is fixedly connected to the coupler knuckle spindle (1).

9. The automatic uncoupling mechanism for coupler according to claim 8, wherein, the boss stopper (6) is arranged on the second rotating member (7) and connected to the coupler knuckle spindle (1) via the second rotating member (7).

10. The automatic uncoupling mechanism for coupler according to claim 8, wherein, a groove (10) is formed on a side wall of the coupler knuckle spindle (1) or on the second rotating member (7); the boss stopper (6) is a radial sidewall (11) of the groove; and a dimension of the groove (10) in a circumferential direction of the coupler knuckle spindle (1) or the second rotating member (7) is greater than or equal to the maximum movement distance of the boss (5).

11. The automatic uncoupling mechanism for coupler according to claim 10, wherein, arrangement positions between the boss (5) and the groove (10) are changed with each other; the boss and the groove are matched with each other; and the boss is driven to move by the groove.

12. The automatic uncoupling mechanism for coupler according to claim 11, wherein, the driving unit (2) is an electric cylinder.

13. The automatic uncoupling mechanism for coupler according to claim 11, wherein, a sleeve (19) is provided between an inner wall of the first rotating member (4) and a side face of the coupler knuckle spindle (1).

14. The automatic uncoupling mechanism for coupler according to claim 11, wherein, the second rotating member (7) is fixed on the coupler knuckle spindle (1) by two or more screws (8).

15. The automatic uncoupling mechanism for coupler according to claim 11, wherein, further comprises a manual uncoupling device (20), comprising a handle (21); one end of the handle (21) is a rotating head (22), and a clamping member (23) is provided on a face of the rotating head (22); the clamping member (23) is of a raised structure or a hole structure.

16. The automatic uncoupling mechanism for coupler according to claim 12, wherein, a sleeve (19) is provided between an inner wall of the first rotating member (4) and a side face of the coupler knuckle spindle (1).

17. The automatic uncoupling mechanism for coupler according to claim 12, wherein, the second rotating member (7) is fixed on the coupler knuckle spindle (1) by two or more screws (8).

18. The automatic uncoupling mechanism for coupler according to claims 8, wherein, the second rotating member (7) is located above the rotating part (402) and is a cover plate structure.

19. An automatic uncoupling mechanism for couplers, comprising a coupler knuckle spindle (1) and a driving unit (2);

the driving unit (2) comprises a cylinder body (201) hinged to a coupler body (3), and a telescopic member (202) axially movable along the cylinder body (201);

wherein, the automatic uncoupling mechanism further comprises a first rotating member (4), a boss (5) and a boss stopper (6);

the first rotating member (4) comprises a crank (401) hinged to the telescopic member (202), and a rotating part (402) fixedly connected to the crank (401), with the rotating part (402) being sheathed on the coupler knuckle spindle (1);

the driving unit (2) unidirectionally drives the telescopic member (202) so that the rotating part (402) drives the coupler knuckle spindle (1) to unidirectionally rotate by a contact of the boss (5) with the boss stopper (6), so as to realize coupler uncoupling; and, after the driving unit (2) drives the telescopic member (202) to return to its position, the rotation of the coupler knuckle spindle (1) for achieving coupler coupling is not limited by the rotating part (402);

wherein, the boss (5) is fixedly mounted on the rotating part (402); a groove (10) is formed on a side wall of the coupler knuckle spindle (1); the boss stopper (6) is a radial sidewall (11) of the groove; and a dimension of the groove (10) in a circumferential direction of the coupler knuckle spindle (1) is greater than or equal to the maximum movement distance of the boss (5).

20. An automatic uncoupling mechanism for couplers, comprising a coupler knuckle spindle (1) and a driving unit (2);

the driving unit (2) comprises a cylinder body (201) hinged to a coupler body (3), and a telescopic member (202) axially movable along the cylinder body (201);

wherein, the automatic uncoupling mechanism further comprises a first rotating member (4), a boss (5) and a boss stopper (6);

the first rotating member (4) comprises a crank (401) hinged to the telescopic member (202), and a rotating part (402) fixedly connected to the crank (401), with the rotating part (402) being sheathed on the coupler knuckle spindle (1);

the driving unit (2) unidirectionally drives the telescopic member (202) so that the rotating part (402) drives the coupler knuckle spindle (1) to unidirectionally rotate by a contact of the boss (5) with the boss stopper (6), so as to realize coupler uncoupling; and, after the driving unit (2) drives the telescopic member (202) to return to its position, the rotation of the coupler knuckle spindle (1) for achieving coupler coupling is not limited by the rotating part (402);

wherein, the automatic uncoupling mechanism further comprises a second rotating member (7) for limiting the movement of the rotating part (402) in an axis direction of the coupler knuckle spindle (1), and the second rotating member (7) is fixedly connected to the coupler knuckle spindle (1);

the boss (5) is fixedly mounted on the rotating part (402); and a groove (10) is formed on a side wall of the coupler knuckle spindle (1) or on the second rotating member (7); the boss stopper (6) is a radial sidewall (11) of the groove; and a dimension of the groove (10) in a circumferential direction of the coupler knuckle spindle (1) or the second rotating member (7) is greater than or equal to the maximum movement distance of the boss (5).

* * * * *